US006357090B1

(12) United States Patent
Murai

(10) Patent No.: US 6,357,090 B1
(45) Date of Patent: Mar. 19, 2002

(54) TWIST LATCH

(75) Inventor: Ryukichi Murai, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/695,913

(22) Filed: Oct. 26, 2000

(30) Foreign Application Priority Data

Oct. 29, 1999 (JP) ..... 11-308915

(51) Int. Cl.[7] ..... A41F 1/00; A45C 13/10; E05B 65/52; F16B 21/07

(52) U.S. Cl. ..... 24/593.1; 24/590; 24/595; 24/597

(58) Field of Search ..... 24/590, 593, 597, 24/594, 606

(56) References Cited

U.S. PATENT DOCUMENTS

| | | | | | |
|---|---|---|---|---|---|
| 2,011,472 | A | * | 8/1935 | Chobert | 24/590 |
| 4,599,768 | A | * | 7/1986 | Doyle et al. | 24/590 |
| 4,653,708 | A | * | 3/1987 | Rich | 24/590 |
| 5,134,757 | A | * | 8/1992 | Johnson | 24/590 |
| 5,368,427 | A | * | 11/1994 | Pfaffinger | 24/593 |

* cited by examiner

*Primary Examiner*—Victor N. Sakran
(74) *Attorney, Agent, or Firm*—Finnegan, Henderson, Farabow, Garrett & Dunner, L.L.P.

(57) ABSTRACT

A plug of a twist latch is comprised of a main body, knob body and fixing plate. The main body has a shaft-bearing portion provided on a base, whose outer shape is an ellipse and having a circular hole portion inside. An upper portion of the shaft-bearing portion is a contracted diameter portion while a lower portion thereof is an expanded diameter portion. Several protruded ridge portions are provided on the expanded diameter portion to form an engaging portion. The knob body has a knob portion of an ellipse-trapezoidal shape having a shaft portion extended from a bottom face thereof. The shaft portion is divided along an axis thereof. This shaft portion is rotatably fit into the shaft-bearing portion. The fixing plate has a hole portion in which the shaft-bearing portion can be inserted, and is formed with fitting portions that can be fit onto an engaging portion, on the periphery of the hole portion. When this plug is mounted on a cloth, the shaft-bearing portion is inserted from a back side of the cloth. Upon use of this plug, the knob body is inserted into a socket provided on a mating cloth and the knob portion is turned so as to engage the plug with the socket. Thus, the plug can be attached from a back side of a cloth such as a bag, and the twist latch has a tough structure and a good appearance and does not easily slip out of the cloth.

10 Claims, 13 Drawing Sheets

TWIST LATCH

BACKGROUND OF THE INVENTION

1. Field of the Invention

The present invention relates to a latch to be used for fixing a cover of a knapsack, bag or the like to its main body. More particularly, it relates to a twist latch wherein a knob attached to the main body is inserted into a hole portion formed in the cover from a back side thereof and then the knob appearing from the surface is twisted around so as to be fixed to the hole portion.

2. Description of the Related Art

FIG. 21 shows a conventional twist latch, disclosed in Japanese Utility Model Publication No. 5-3651. According to this invention, a main body 4' is a rectangular box extended in its lateral direction whose bottom face is open. A square shaft-bearing portion 11' in which a shaft 27' of the knob 25' is to be inserted is provided in a center of the main body 4' and elastic pieces 52' are disposed at a bottom end of the shaft-bearing portion 11' so as to oppose each other. Then, a plate-like bottom portion 10' extended in a lateral direction is provided at a bottom end of the main body 4' and pair of leg portions 50', 50' are provided so as to protrude on the bottom face of the bottom portion 10'. A saw-tooth like engaging step portion 50*a'* is provided on an outer side face of each leg portion 50'. The knob 25' has the protruding shaft 27'in a center of the bottom face thereof so as to be inserted into the shaft-bearing portion 11'. A plate 6' is provided with through holes 32' in which each of the leg portions 50', 50' is to be fitted from a back side of the main body 4' and a pawl 51' is provided so as to be protruded at each through hole 32' so that it is capable of fitting to the engaging step portion 50*a'* of the leg portion 50'. The leg portions 50', 50' of the main body 4' are inserted through a surface of a cloth and the plate 6' is press-fit onto the leg portions 50', 50' from a back side of the cloth so that it is fixed thereto.

FIG. 22 shows another twist latch, which is disclosed in Japanese Utility Model Publication No. 5-4530. According to this twist latch, a main body of a plug 1" has a shaft-bearing portion 11" protruded upward in a center of a base 10" of an ellipse shape, and an interior of the shaft-bearing portion 11" is formed such that its upper side is of small diameter while its lower side is of large diameter. A through hole 55" is formed on each of both the right and left sides of the base 10". A rivet 54" is inserted into each of the through holes 55", while a cloth is nipped by the main body and a rear plate 60" so that it is riveted. A knob body 5" has a shaft portion 27" provided in a center of a bottom of a rectangular knob 25", and the shaft portion 27" is divided into a cross shape so as to provide the shaft portion 27" with elasticity. An expanded portion 29" is provided at a tip of the shaft portion 27". When it is inserted into a large diameter portion 22" of the shaft-bearing portion 11", the shaft portion 27" is supported therein so as to be rotatable. Further, a corresponding socket 2" has rivets 53" protrudedly provided on both the right and left sides of the base 40" containing a rectangular through hole 56" through which the knob 25" of the knob body 5" can be inserted. This base 40" is overlaid on a surface of a cloth and further a plate having rivet holes are overlaid on a back face of the cloth. Finally, with the cloth sandwiched, the rivets 53" provided on the base 40" are pressed and crushed to fix the cloth.

In the twist latch shown in FIG. 21 described above, a pair of the leg portions 50', 50' provided on a bottom face of the plug main body 4' is inserted through the surface of the cloth such as a bag, and then, through holes 32', 32' of the plate 6' are fit onto the leg portions 50', 50' existing on the back side of the cloth so as to mount the main body 4' on the cloth. Therefore, if the plug main body 4' is pulled strongly in a direction away from the surface of the cloth, the plug main body 4' may be departed from the cloth easily when the plate is removed from the leg portions 50', 50' of the plug main body 4', because there is no means for preventing a slip-out of the leg portions 50', 50' from the through holes 32', 32' except the engaging step portions 50*a'*, 50*a'* formed on the leg portions 50', 50'. Further, the leg portions 50', 50' may be protruded out of the plate 6', thereby causing a problem that the protruded leg portions 50', 50' may catch contents of the bag.

In the twist latch shown in FIG. 22, the plug main body is set to the surface of a cloth such as a bag while the plate 60" is placed on a back side of the cloth so as to nip the cloth. Then, the main body and the plate 60" are fixed together with rivets 54" so that the main body is fixed onto the cloth. Therefore, a quantity of components increases, which leads to increase of production cost, and inventory control of the components becomes complicated. Further, the attachment work using the rivets 53", 54" is troublesome.

SUMMARY OF THE INVENTION

The present invention has been achieved in views of the above-described problems. Therefore, an object of a first aspect of the present invention is to provide a plug of a twist latch ensuring safety because the plug is not protruded inside a bag and having a good appearance, bearing a long-term use and facilitating an attachment work thereof. For this purpose, a main body of the plug of the twist latch is inserted into a hole portion provided on a cloth such as a bag from a back side of the cloth and a fixing plate is fit to the plug main body appearing on the surface of the cloth from that surface, so that the plug main body can be attached firmly with stability to the cloth in a condition that it is fixed to the back side of the cloth.

Further, an object of a second aspect of the present invention is to provide a plug of a twist latch which facilitates attachment of the plug onto a cloth and insertion of the plug into a hole portion of a socket or fixing plate mounted to a cover.

Furthermore, an object of a third aspect of the present invention is to provide a plug of a twist latch which can be fixed firmly to a cloth by means of a simple mechanism and attached easily to adapt to a thickness of the cloth.

Still further, an object of a fourth aspect of the present invention is to provide a plug of a twist latch whose knob body can be attached to the main body easily and which has a knob portion having such a shape that facilitates gripping and operating thereof.

Still further, an object of a fifth aspect of the present invention is to provide a socket of a twist latch which can be engaged with the plug easily and fixed to a cloth in a stabilized condition by specifying a shape of the socket to correspond to the plug.

Still further, an object of a sixth aspect of the present invention is to provide a plug and a socket of a twist latch which allow the fixing plate to be engaged with the plug and socket easily so that the twist latch can be attached to a cloth easily.

Still further, an object of a seventh aspect of the present invention is to provide a fixing plate of a twist latch which can be commonly used for both the plug and the socket thereby realizing an effective attachment work.

Still further, an object of an eighth aspect of the present invention is to provide a plug and a socket of a twist latch having a structure capable of fixing the fixing plate to the plug and socket firmly in a stabilized condition.

Still further, an object of a ninth aspect of the present invention is to provide a fixing plate of a twist latch capable of achieving a firm fixing by specifying a shape of the fixing plate to be used for the plug and the socket.

Finally, an object of a tenth aspect of the present invention is to provide a plug and a socket of a twist latch which can be produced easily by limiting material to be used for the twist latch and whose recycling can be achieved.

To achieve the above objects, in order to firmly attach a twist latch to a cloth, such as a bag, by inserting the latch from a back side of the cloth, according to the first aspect of the present invention, there is provided a twist latch including a plug comprising: a main body having a cylindrical shaft-bearing portion protruded from a base; a knob body having a shaft portion containing a knob portion at an end portion thereof and adapted to be supported rotatably by said shaft-bearing portion; and a fixing plate adapted to be mounted onto and fit to an outer face of said shaft-bearing portion, wherein said shaft-bearing portion protruding from an upper face of the base has an engaging portion in an intermediate portion thereof, said fixing plate has a hole portion in which said shaft-bearing portion can be inserted, and said hole portion has fitting portions formed on a periphery thereof and adapted to be fit onto said engaging portion. Thus, the cloth can be nipped between the main body and the fixing plate by use of the shaft-bearing portion.

Further, according to the second aspect of the present invention, there is provided a twist latch wherein an outer peripheral face of the shaft-bearing portion of the main body of the plug is formed with a contracted diameter portion, whose diameter is smaller, extending from a top end to an intermediate portion of the shaft portion while an outer peripheral portion thereof extending from the intermediate portion to the base is formed with an expanded diameter portion, the engaging portion being formed at said expanded diameter portion on a side of a beginning end thereof.

Furthermore, according to the third aspect of the present invention, there is provided a twist latch wherein the engaging portion provided on the shaft-bearing portion of the main body of the plug is formed of several protruded ridge portions protruded from an outer peripheral face of the shaft-bearing portion and the fixing plate has tongue-like fitting portions in the periphery of the hole portion, which can be fit between the protruded ridge portions.

Still further, according to the fourth aspect of the present invention, there is provided a twist latch wherein the knob body of the plug is provided, a shaft portion is provided so as to protrude from a bottom face of the knob portion, the shaft portion is divided along its longitudinal direction by cross-like dividing grooves and has at its divided tip end an expanded head, cross-like convex rows to be protruded into the dividing grooves are formed in alignment with the dividing grooves on a bottom face of the knob portion, a through hole is provided inside the shaft-bearing portion of the main body such that a small-diameter hole is formed on an upper side and a large-diameter hole is formed on a lower side thereof, and cross-like concave grooves are provided in a top face of the shaft-bearing portion so as to coincide with the convex rows, wherein the shaft portion of the knob body is adapted to be inserted into the shaft-bearing portion so as to be intermittently rotatable therein.

Still further, according to the fifth aspect of the present invention, there is provided a twist latch wherein a socket corresponding to the plug has a cylindrical portion formed in a base of a main body thereof and having an inside diameter larger than an outside diameter of a contracted diameter portion of the shaft-bearing portion of the plug, several protruded ridge portions are provided on an outer peripheral surface of the cylindrical portion on a side of its top end so as to form an engaging portion, and a fixing plate is provided with tongue-like fitting portions formed in an inner periphery thereof and adapted to be fit onto said engaging portion.

Still further, according to the sixth aspect of the present invention, there is provided a twist latch wherein the engaging portion of the shaft-bearing portion of the main body of the plug and the engaging portion of the cylindrical portion of the main body of the socket are identical in shape, and each of the engaging portions is formed of several inclined faces on a side for inserting the fixing plate and several horizontal faces on a bottom thereof at a predetermined interval, respectively.

Still further, according to the seventh aspect of the present invention, there is provided a twist latch wherein the fixing plate for the plug and the fixing plate for the socket are identical in shape so that it can be commonly used for the plug and the socket.

Still further, according to the eighth aspect of the present invention, there is provided a twist latch wherein the shaft-bearing portion of the main body of the plug and the cylindrical portion of the main body of the socket has an ellipse cross sectional outer shape in order to facilitate stable fixing, and the engaging portion formed of several protruded ridge portions is respectively provided on an entire peripheral face of each of the shaft-bearing portion and the cylindrical portion so as to achieve firm fixing.

Still further, according to the ninth aspect of the present invention, wherein the periphery of the hole portion in the center of the fixing plate is formed with several cutout portions provided in the periphery of the hole portion of the fixing plate so as to form the tongue-like fitting portions so that it can perform resilient deformation easily.

Finally, according to the tenth aspect of the present invention, there is provided a twist latch wherein the main body, the knob body and the fixing plate of the plug and the main body of the socket are molded by injection molding or extrusion using thermoplastic resin.

DESCRIPTION OF THE EMBODIMENTS

Hereinafter, the embodiments of a twist latch of the present invention will now be described in detail with reference to the accompanying drawings.

Figure 1:
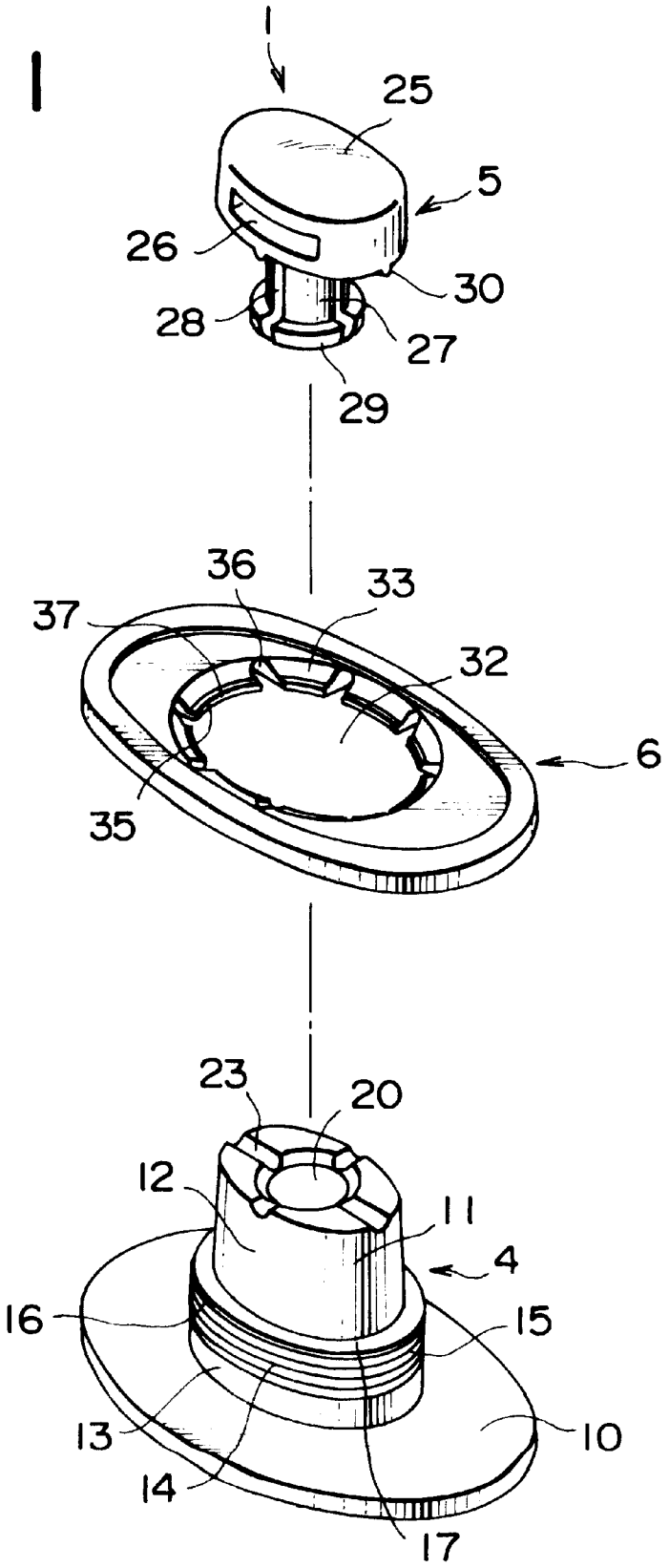
FIG. 1 is an exploded perspective view of a plug of a twist latch.
Figure 2:
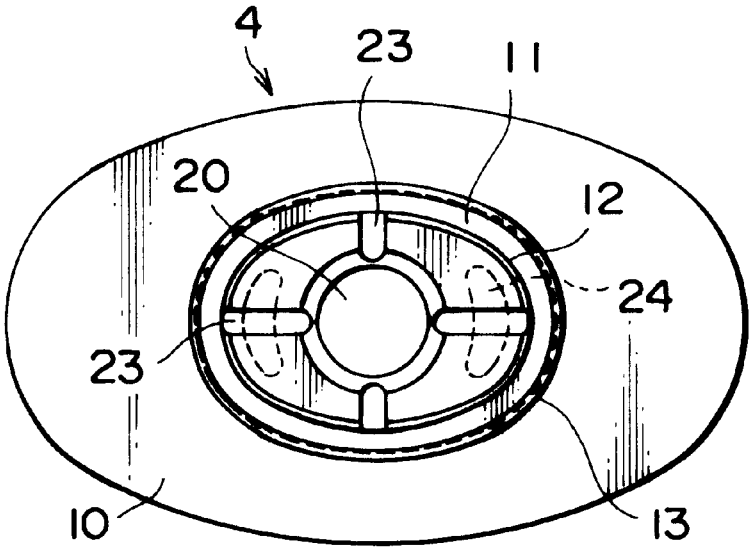
FIG. 2 is a plan view of a main body of the plug.

As shown in FIG. 1, a plug 1 of the twist latch of the present invention is comprised of a main body 4, a knob body 5 and a fixing plate 6. The main body 4 is formed of a base 10 whose plan shape is of an ellipse as shown in FIG. 2, and a cylindrical shaft-bearing portion 11 is provided so as to protrude in a center of the base 10 with its outside being of ellipse and its inside being circular. An outer face of the shaft-bearing portion 11 in a range from a top end to an intermediate portion is formed of a contracted diameter portion 12 whose diameter is smaller while an outer face thereof in a range from the intermediate portion to the base 10 is formed of an expanded diameter portion whose diameter is larger. The contracted diameter portion 12 is formed in the form of a slope such that the diameter increases slightly from the top end to a boundary to the expanded diameter portion, so that a guide performance for mounting a cloth C such as of a bag or the fixing plate 6 is intensified.

Figure 4:
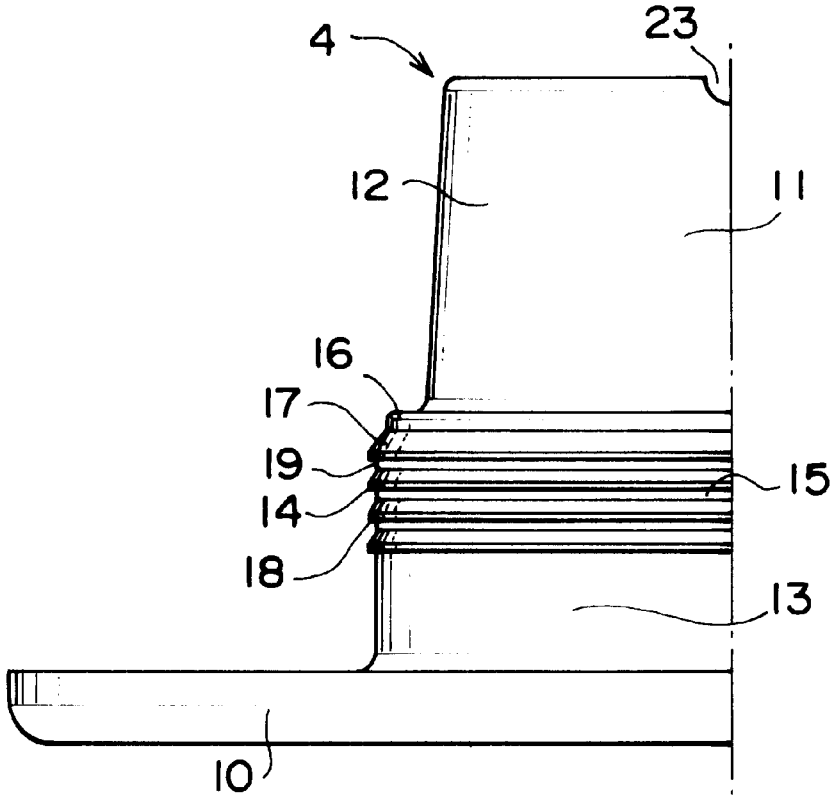
FIG. 4 is an enlarged front view of an engaging portion of the main body of the plug.

Several pieces of protruded ridge portions 14 are formed at the expanded diameter portion 13 of the shaft-bearing portion 11 extending from a beginning end 16 toward the base 10, so that an engaging portion 15 capable of engaging with the fixing plate 6 is formed. Each of the protruded ridge portions 14 of this engaging portion 15 is comprised of an inclined face 17 whose top face onto which the fixing plate 6 is to be inserted is inclined and a horizontal face 18 whose bottom portion is horizontal, as shown in FIG. 4. A slight vertical wall 19 is formed between a base portion of the inclined face 17 and a base portion of the horizontal face 18 so that the fixing plate 6 can be fixed easily.

Figure 3:
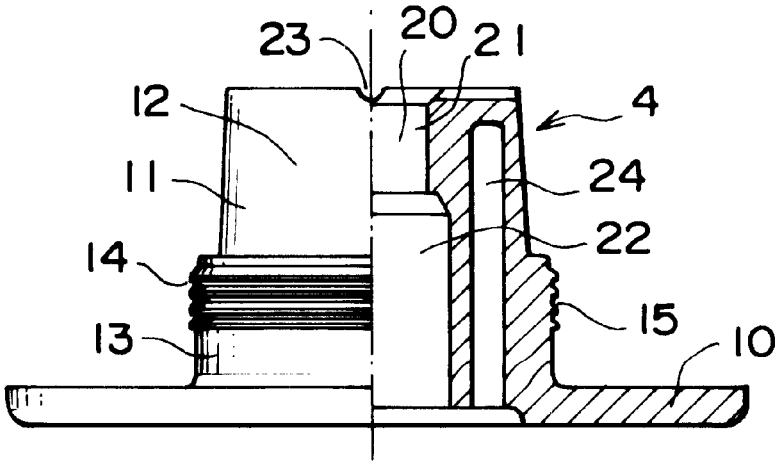
FIG. 3 is a partially broken front view of the main body of the plug.

A circular through hole 20 is provided inside the shaft-bearing portion 11 such that the knob body 5 can be inserted. As shown in FIG. 3, an upper portion of this through hole 20 is formed with a small-diameter hole 21 whose diameter is smaller and at a lower portion thereof with a large-diameter portion 22 whose diameter is larger. An expanded head 29 formed on a knob body 5 is adapted to be received in this large-diameter portion 22. Cross-like concave grooves 23 for receiving cross-like convex rows 30 formed on a bottom face of a knob portion 25 of the knob body 5 are formed in a top face, namely, a top end of the shaft-bearing portion 11 such that positions of the cross-like concave grooves 23 coincide with that of the cross-like convex rows 30, so that the knob body 5 can be rotated intermittently. A crescent-like hole portion 24 is formed in a thick portion between an ellipse shaped outer face of the shaft-bearing portion 11 and an inner face of the hole portion 20 such that it extends upward from a bottom portion so as to provide the shaft-bearing portion 11 with elasticity. Consequently, an inserting operation of an expanded head 29 of the knob body 5 and the fixing plate 6 can be carried out easily.

Figure 5:
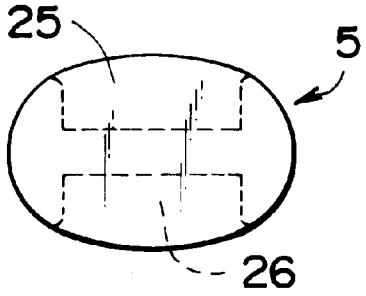
FIG. 5 is a plan view of a knob body of the plug.
Figure 6:
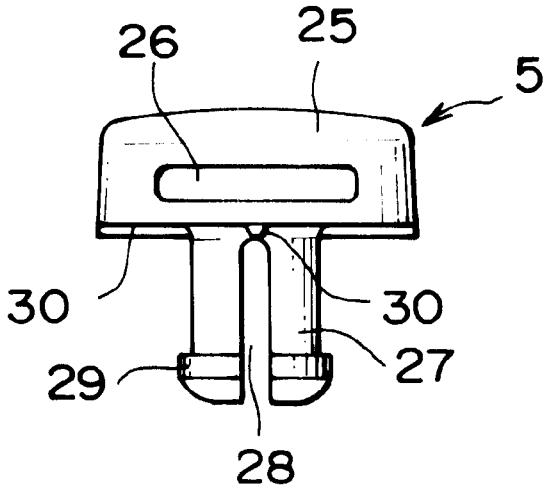
FIG. 6 is a front view of the knob body.
Figure 7:
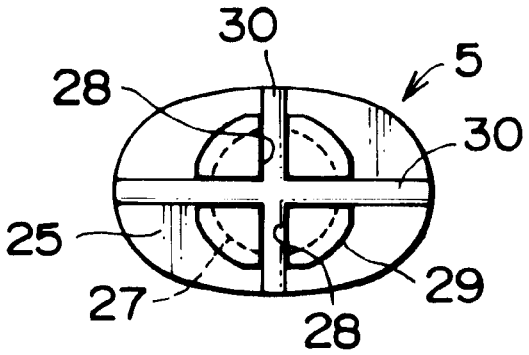
FIG. 7 is a bottom view of the knob body.

The knob body 5, which is to be inserted into the shaft-bearing portion 11 of the main body 4, will now be described. As shown in FIGS. 5 to 7, an ellipse-trapezoidal shaped knob portion 25 is provided so as to facilitate gripping of the knob body 5. Further, recesses 26 are provided on both sides of the knob portion 25 so as to further facilitate the gripping of the knob portion 25. A circular shaft portion 27 is provided so as to protrude on a center of a bottom face of the knob portion 25. The circular shaft portion 27 reaches the large-diameter hole 22 of the shaft-bearing portion 11 when it is inserted into the through hole 20 of the shaft-bearing portion 11. The shaft portion 27 is divided to four sections in a range of a front end thereof to a bottom face of the knob portion 25 by cross-like dividing grooves 28. An expanded head 29 is provided at a tip end of each of the four-divided shaft portions 27 such that it is expanded sideway of the shaft portions. Thus, when it is inserted into the through hole 20 of the shaft-bearing portion 11, the expanded head 29 engages with the large-diameter hole 22 of the shaft-bearing portion 11 so that it is prevented from being easily removed. A convex row 30 is provided along each dividing groove 28 of the cross-like dividing grooves 28 of the shaft portion 27 such that it is protruded. Consequently, these protruded rows 30 engage with the concave grooves 23 provided in the top face of the shaft-bearing portion 11 so that the knob portion 25 can be rotated intermittently.

Figure 8:
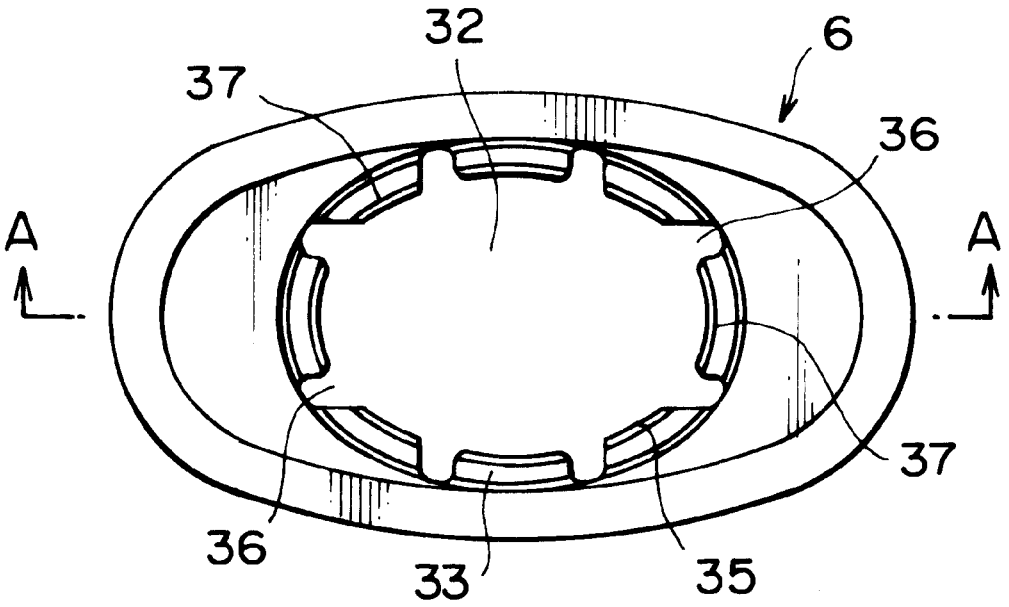
FIG. 8 is a plan view of a fixing plate of the plug.
Figure 9:
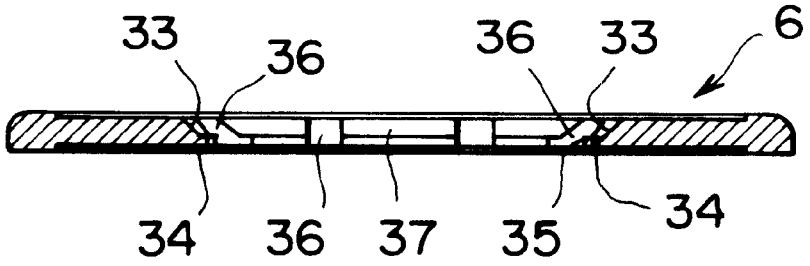
FIG. 9 is a sectional view taken along the line I—I in FIG. 8.

The fixing plate 6, which is to engage with the engaging portion 15 of the shaft-bearing portion 11 of the main body 4, will be described. The fixing plate 6 is entirely an ellipse shape as shown in FIGS. 8 and 9. An ellipse shaped hole portion 32 is provided in a center of the fixing plate 6 so that the shaft-bearing portion 11 of the main body 4 is capable of engaging with the hole. An inclined face 33 is provided on one face, namely, a top face on a periphery of this hole portion 32 while a horizontal face 34 is formed on the other face, namely, a bottom of the periphery. An end portion 35, which horizontally projects toward a center of the hole portion 32, is formed at an end of the periphery, namely, an end portion of the inclined face 33 and horizontal face 34, so that the end portion 35 can be fitted between the protruded ridge portions 14 of the engaging portion 15 of the shaft-bearing portion 11 of the main body 4. Further, a plurality of substantially radial dented cutout portions 36 are provided at a predetermined gap on the inclined face 33 on the periphery of the hole portion 32 so as to form tongue-like fitting portions 37, so that the fixing plate 6 is capable of engaging with the engaging portion 15 of the shaft-bearing portion 11 easily. By providing the inclined face 33 with the cutout portions 36 in a substantially radial shape at the predetermined gap, the divided fitting portions 37 are made easily elastically deformable. The respective fitting portions 37 are capable of engaging with the engaging portion 15 with such elastic force so that they are fit thereto equally and firmly.

The plug 1 of the twist latch has been described above. However, depending on the plug 1, a socket 2 corresponding thereto is required. The socket 2 in this case will now be described. A cylindrical portion 42 having an inside diameter larger than an outside diameter of the contracted diameter portion 12 having a small diameter of the shaft-bearing portion 11 of the plug 1 is provided so as to protrude in the center of an ellipse shaped base 41 of a main body 40. The outside diameter of the cylindrical portion 42 is the same as the outside diameter of the enlarged diameter portion 13 of the shaft-bearing portion 11. Then, several pieces of protruded ridge portions 43 having the same shape as the engaging portion 15 provided at the beginning end of the enlarged diameter portion 13 of the shaft-bearing portion 11 are provided on a front end side of the cylindrical portion 42, so that an engaging portion 44 is formed. Each protruded ridge portion 43 has an inclined face 45 on one face while a horizontal face 46 is formed on the other face. A vertical wall 47 having a slight length is formed between a base portion of the inclined face 45 and the horizontal face 46, so that the fixing plate 6 can be fit easily.

On the other hand, in order to mount the main body 40 of the socket 2 onto the cloth C, a fixing plate 6 for fixing the socket 2 to the engaging portion 44 formed on the cylindrical portion 42 provided on the base 41 of the main body 40 has the same shape as the fixing plate 6 to be used for the plug 1 and may be used for the socket 2 as well as the plug 1.

Figure 10:
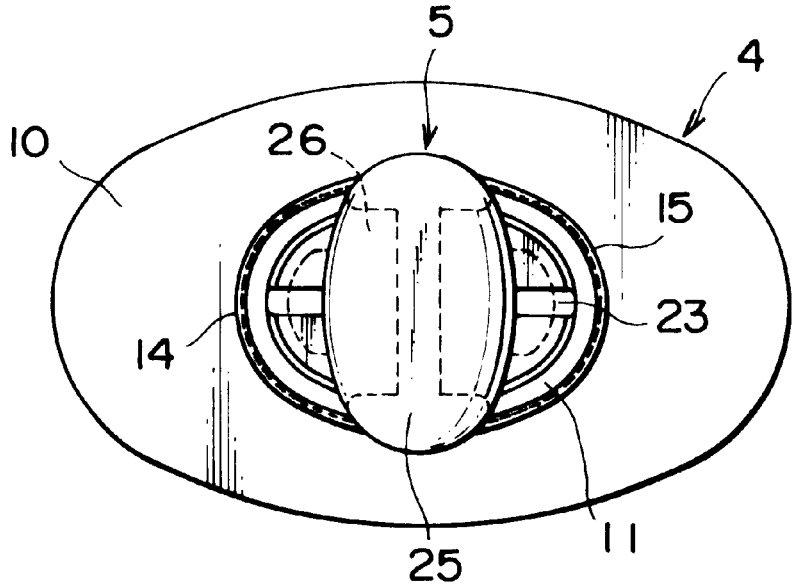
FIG. 10 is a plan view showing a state in which the main body of the plug and the knob body are assembled.
Figure 11:
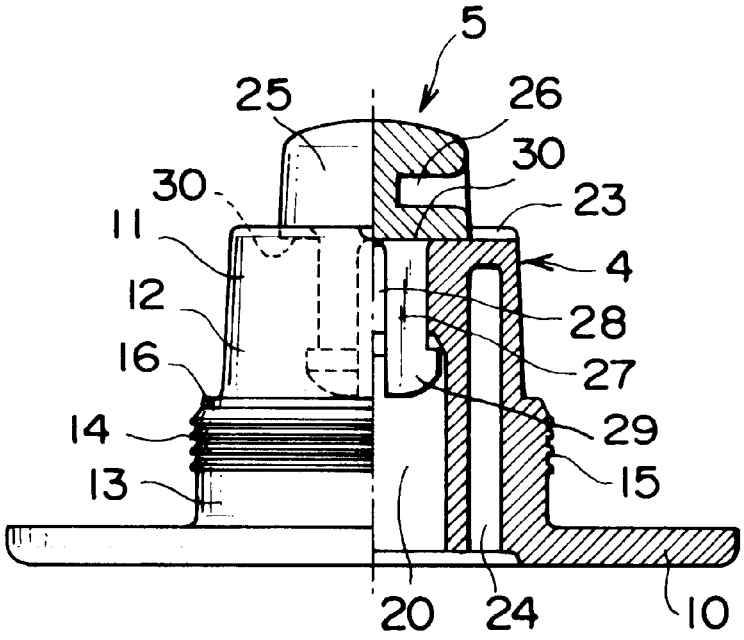
FIG. 11 is a partially broken front view of FIG. 10.
Figure 12:
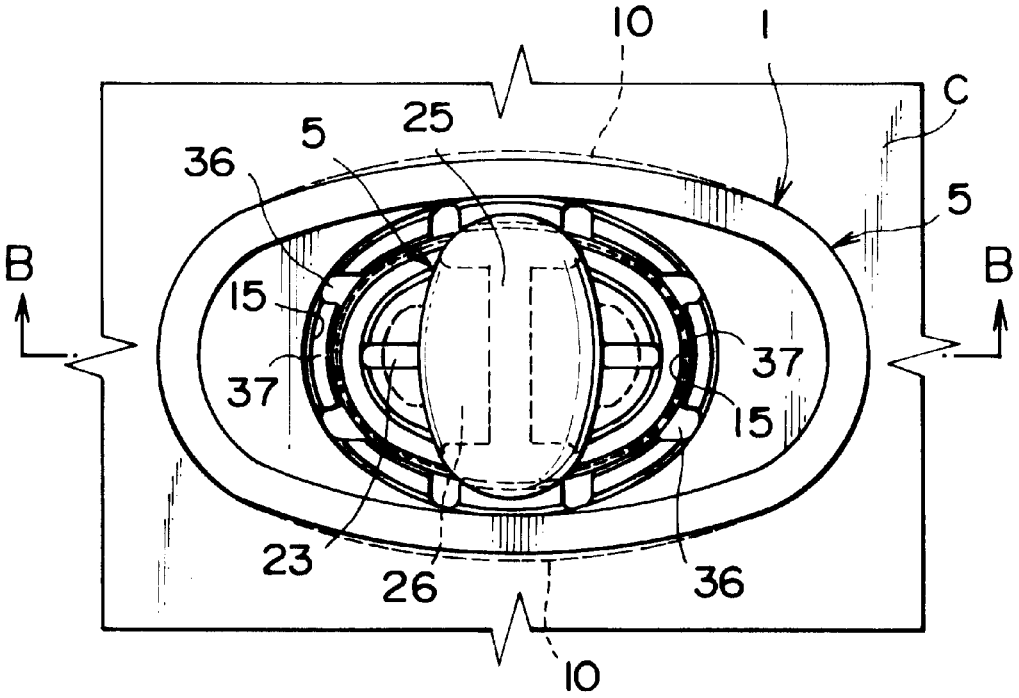
FIG. 12 is a plan view showing a state in which the plug is attached to a cloth.
Figure 13:
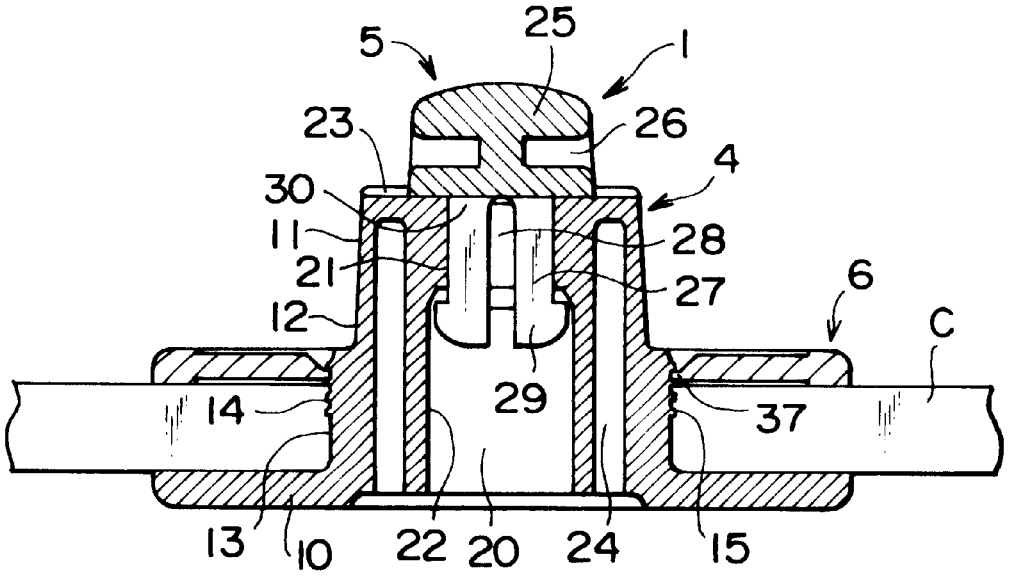
FIG. 13 is a sectional view taken along the line B—B in FIG. 12.
Figure 14:
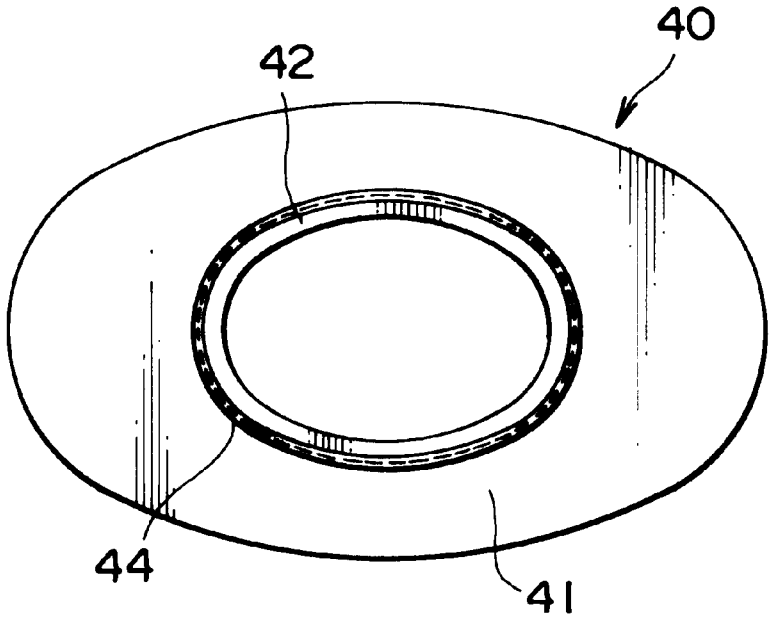
FIG. 14 is a plan view of a main body of a socket of the twist latch.
Figure 15:
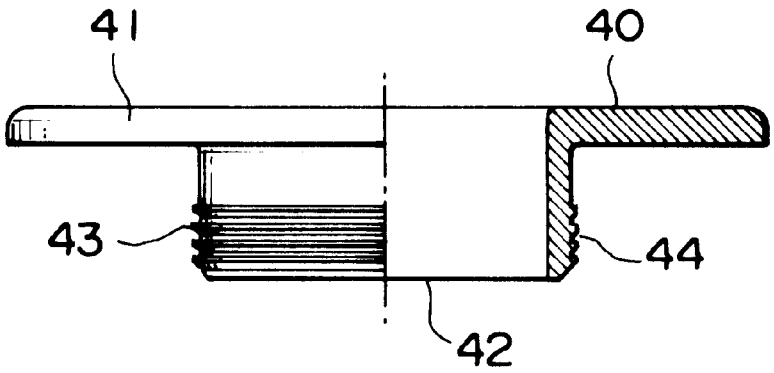
FIG. 15 is a partially broken front view of the main body of the socket.
Figure 16:
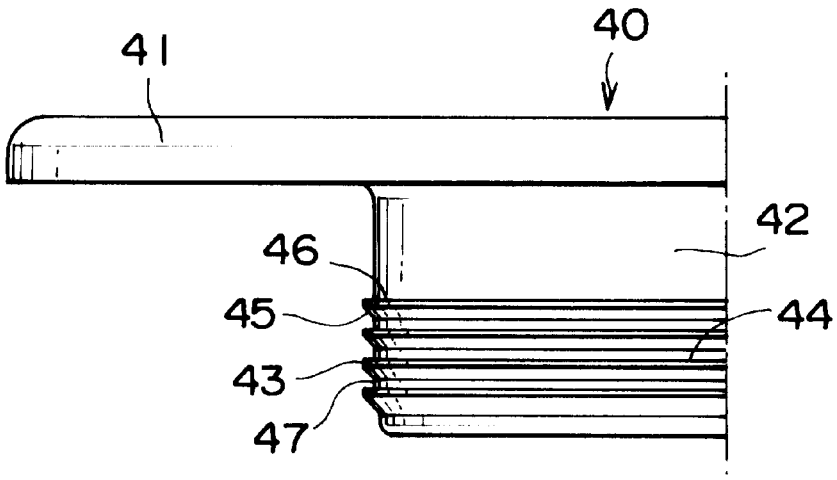
FIG. 16 is an enlarged front view of the engaging portion of the socket.

Next, an operation for using the twist latch will now be described. The expanded head 29 provided at the front end of the shaft portion 27 of the knob body 5 is inserted into the through hole 20 of the shaft-bearing portion 11 of the main body 4 of the plug 1 as shown in FIGS. 10 and 11. Consequently, the expanded head 29 is inserted into the large-diameter portion 22 of the through hole 20, such that the knob portion 25 can be rotated intermittently. Then, an assembly of this main body 4 and the knob body 5 is inserted into a mounting hole formed in a cloth such as a bag such that the knob body 5 protrudes from a back side of the cloth C. Next, as shown in FIGS. 12 and 13, the fixing plate 6 is fit to the shaft-bearing portion 11 via the knob portion 25 so as to nip the cloth C so that the fitting portions 37 of the fixing plate 6 are engaged with and fixed to the engaging portion 15 provided on the shaft-bearing portion 11. As a result, the plug 1 of the twist latch is mounted on the cloth C. The knob portion 25 of this plug 1 is inserted into the mounting hole hemmed in a cover of a bag or the like and twisted by 90° until the knob portion 25 is rotated to intersect the ellipse shaped shaft-bearing portion 11, so that the knob portion 25 can be prevented from being removed from the mounting hole.

Figure 17:
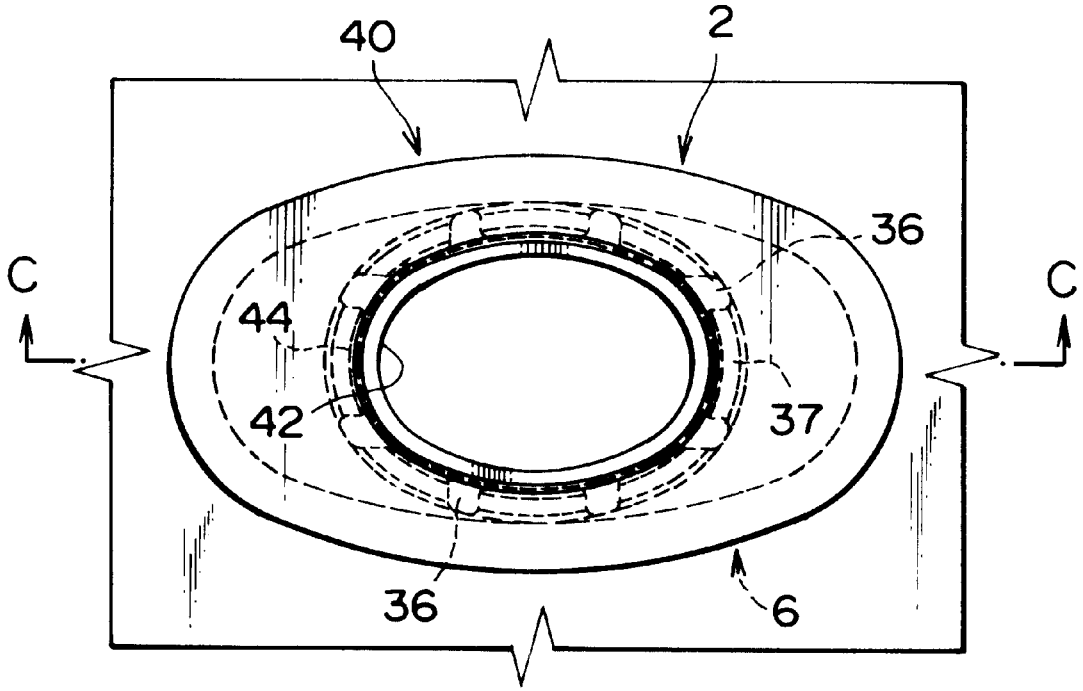
FIG. 17 is a plan view showing a state in which the socket is attached to a cloth.
Figure 18:
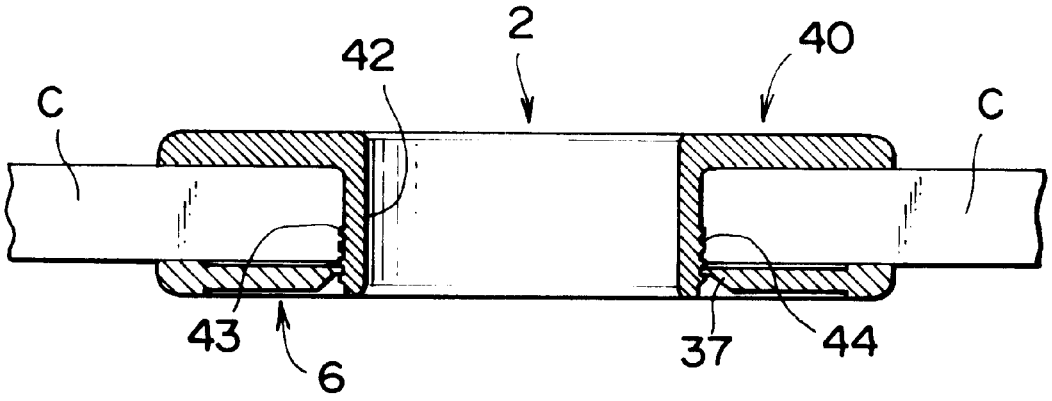
FIG. 18 is a sectional view taken along the line C—C in FIG. 17.
Figure 19:
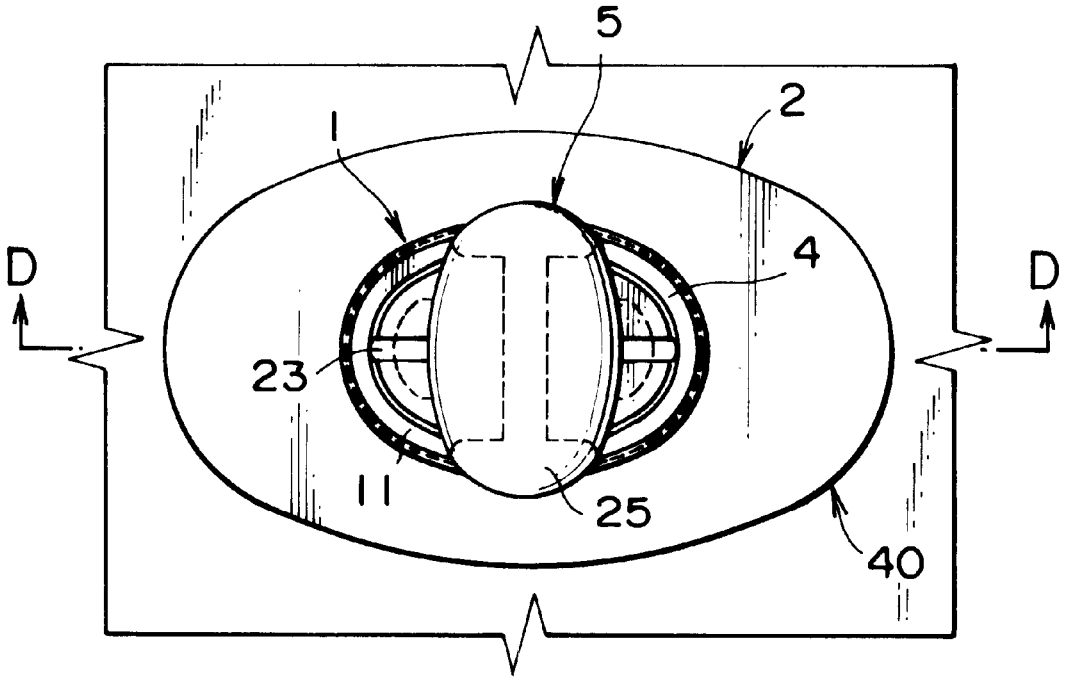
FIG. 19 is a plan view showing a state in which the plug and the socket are engaged with each other.
Figure 20:
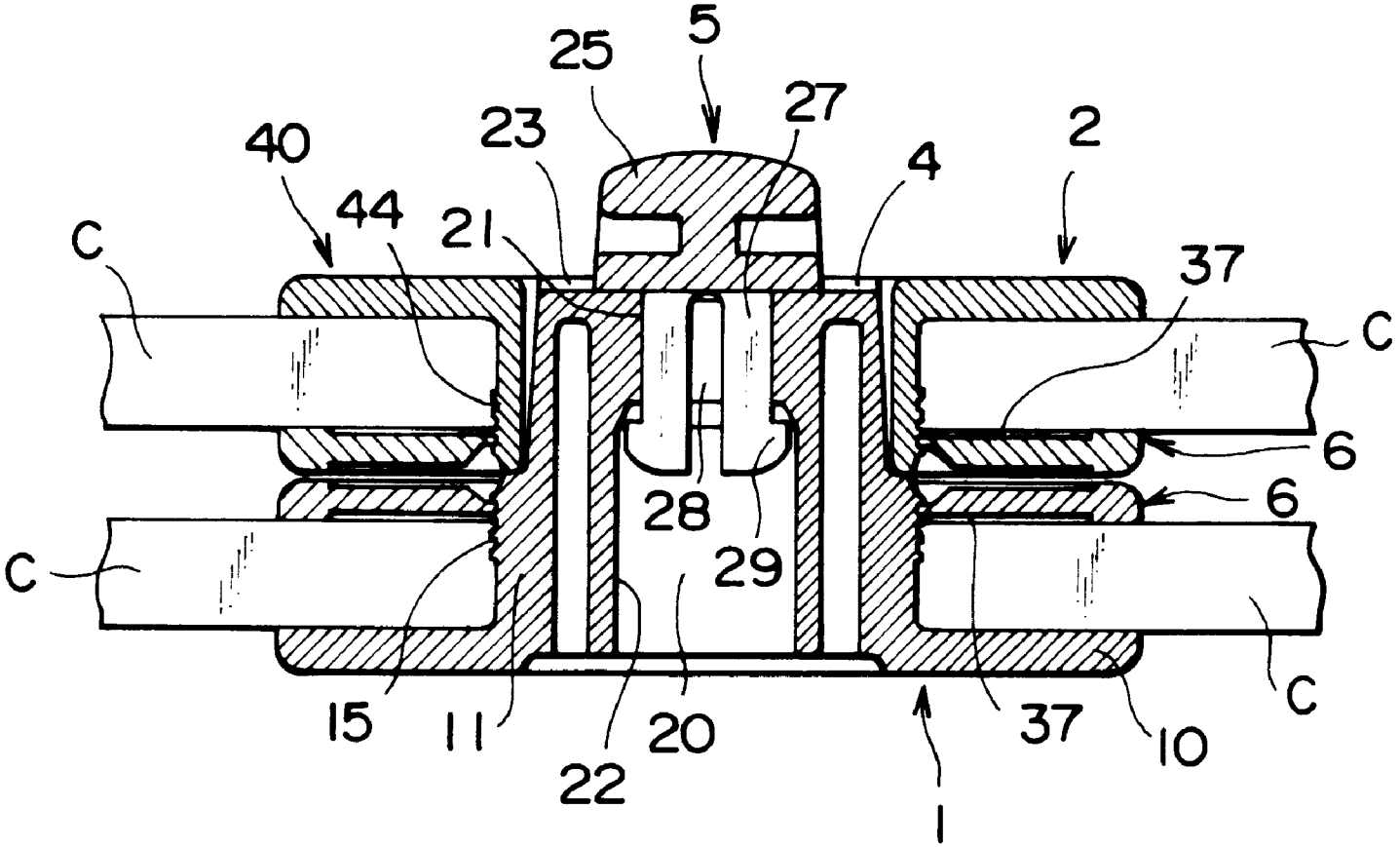
FIG. 20 is a sectional view taken along the line D—D in FIG. 19.
Figure 21:
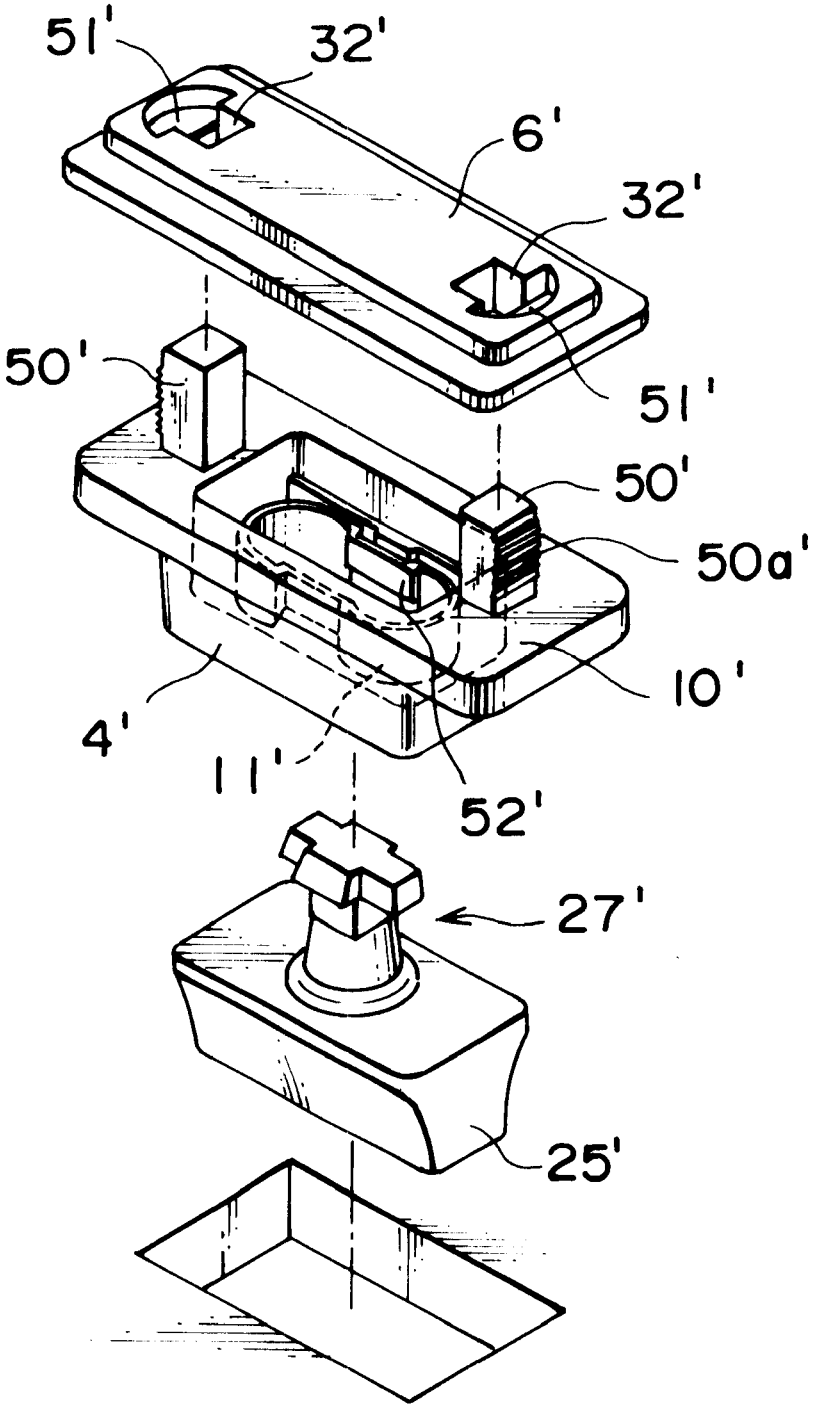
FIG. 21 PRIOR ART
FIG. 21 is an exploded perspective view of a known twist latch.
Figure 22:
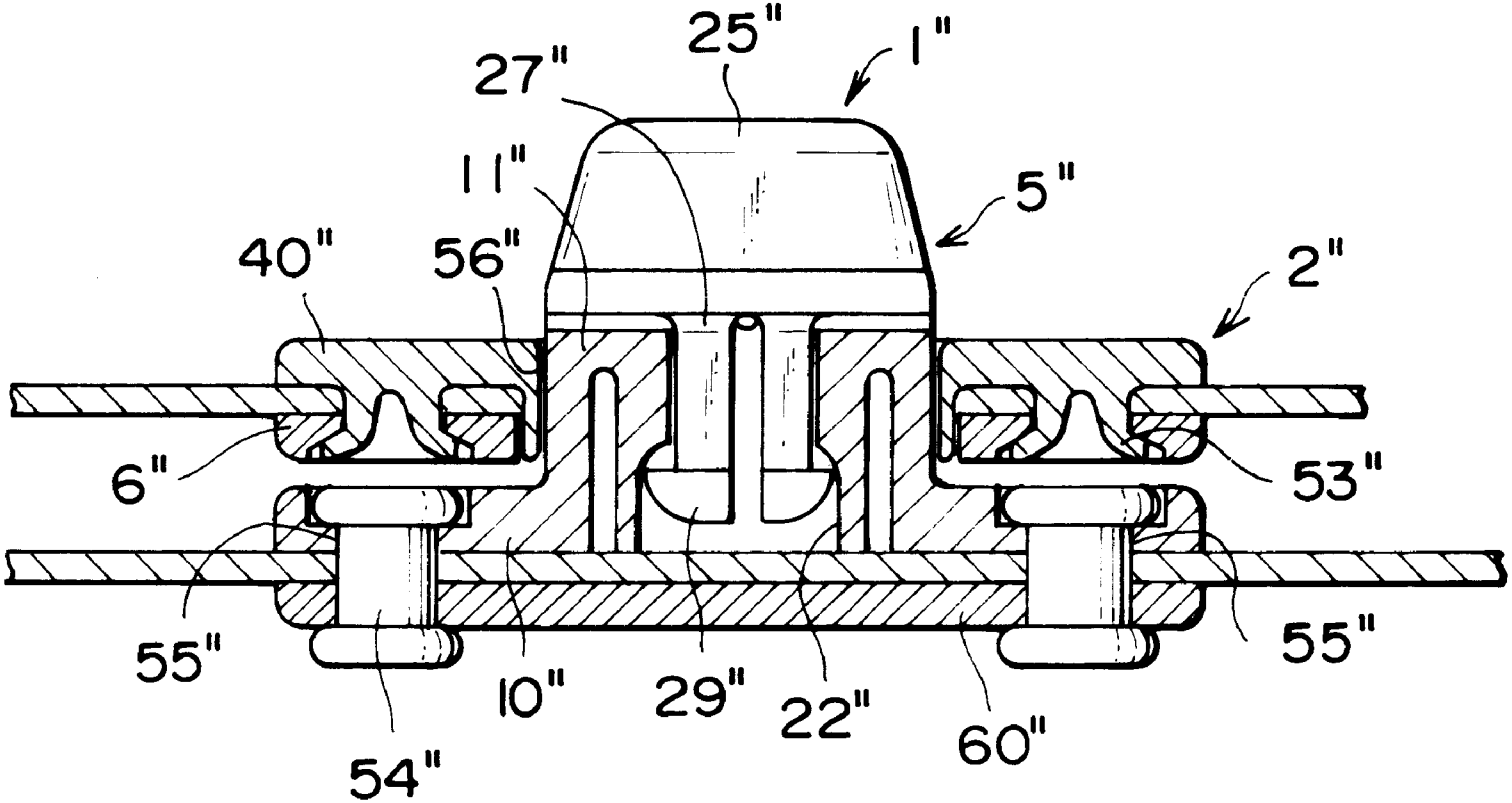
FIG. 22 PRIOR ART
FIG. 22 is a sectional view of another known twist latch.

Further, when the plug 1 and the socket 2 are used, the mounting hole is provided in the cloth C of a bag or the like and the socket 2 of the twist latch is mounted on that mounting hole. At that time, as shown in FIGS. 17 and 18, a cylindrical portion 42 of the main body 40 of the socket 2 is inserted into the cloth C from the surface thereof and then, the fixing plate 6 is fit to the engaging portion 44 provided on the front end side of the cylindrical portion 42 so as to nip the cloth C from the back side thereof. Then, the fitting portions 37 of the fixing plate 6 are fixed to the engaging portion 44 of the cylindrical portion 42, so that the socket 2 of the twist latch is mounted on the cloth C. As shown in FIGS. 19 and 20, the knob portion 25 and the shaft-bearing portion 11 of the plug 1 are inserted into the cylindrical portion 42 of the socket 2 and then, the knob portion 25 is twisted and rotated intermittently so that the knob portion 25 is inhibited from being slipped out of the socket.

Meanwhile, when the fixing plate 6 is fit to the engaging portion 15 formed on the shaft-bearing portion 11 of the main body 4, the horizontal face 34 of the fixing plate 6 may be such a shape that can be in contact with the inclined face 17 of the protruded ridge portion 14. Alternatively, different from this type, the horizontal face 18 of the protruded ridge portion 14 and the horizontal face 34 of the fixing plate 6 such that they come into contact with each other, so that the fitting portions 37 of the fixing plate 6 may be fit to the engaging portion of the shaft-bearing portion 11. In the socket 2 also, the fitting portions 37 of the fixing plate 6 and the engaging portion 44 formed on the cylindrical portion 42 may be disposed in the same manner, so that the fixing plate 6 can be fit to the socket 2.

To facilitate production of the twist latch and attachment work thereof and realize recycling of the products, it is preferable that the main body 4, the knob body 5 and the fixing plate 6 of the plug 1 of the twist latch, and the main body 40 of the socket 2 thereof are formed by injection molding means or extruding means using thermoplastic resing such as polyacetal, polyamide, polypropylene, polybutylene terephalate or the like.

The twist latch of the present invention has the above-described structure. With this structure, the following effects can be achieved.

According to the first aspect of the present invention, there is provided a twist latch including a plug 1 comprising: a main body 4 having a cylindrical shaft-bearing portion 11 protruded from a base 10; a knob body 5 having a shaft portion 27 containing a knob portion 25 at an end portion thereof and adapted to be supported rotatably by said shaft-bearing portion 11; and a fixing plate 6 adapted to be mounted onto and fit to an outer face of said shaft-bearing portion 11, wherein said shaft-bearing portion 11 has an engaging portion 15 in an intermediate portion thereof, said fixing plate 6 has a hole portion 32 in which said shaft-bearing portion 11 can be inserted, said hole portion 32 has fitting portions 37 formed on a periphery thereof and adapted to be fit onto said engaging portion 15. Therefore, because the main body 4 of the plug 1 for the twist latch is inserted from a back side of the cloth C and fit with the fixing plate 6 to the surface, even if the fixing plate 6 is slipped out, the main body 4 can be kept being fit to the cloth C. When the mounting hole provided in a cover of a bag or the like is engaged with the knob portion 25 such that the knob portion 25 cannot be removed from the mounting hole, even if the plug main body 4 is pulled strongly through the knob portion 25 in order to open the cover of the bag by force, the cloth C prevents the plug main body 4 and the fixing plate 6 from being separated from each other. Further, the twist latch can be attached easily and fixed in a stabilized condition and bear a long-term use.

Further, according to the second aspect of the present invention, there is provided a twist latch wherein an outer peripheral face of the shaft-bearing portion 11 of the main body 4 of the plug 1 is formed with a contracted diameter portion 12, whose diameter is smaller, extending from a top end to an intermediate portion of the shaft portion 11 while an outer peripheral portion thereof extending from the intermediate portion to the base 10 is formed with an expanded diameter portion 13, the engaging portion 15 being formed at said expanded diameter portion 13 on a side of a beginning end 16 thereof. As a result, the main body 4 of the plug 1 can be inserted into the cloth C easily and the main body 4 of the plug 1 can be fixed firmly to the cloth C.

Furthermore, according to the third aspect of the present invention, there is provided a twist latch wherein the engaging portion 15 provided on the shaft-bearing portion 11 of the main body 4 of the plug 1 is formed of several protruded ridge portions 14 protruded from an outer peripheral face of the shaft-bearing portion 11 and the fixing plate 6 has tongue-like fitting portions 37 capable of being fit between the protruded ridge portions 14. As a result, when the main body 4 of the plug 1 is attached on the cloth C, its attachment thereof can be adjusted easily depending on the thickness of the cloth C.

Still further, according to the fourth aspect of the present invention, there is provided a twist latch wherein the knob body 5 of the plug 1 has a shaft portion 27 protruding from a bottom face of the knob portion 25, the shaft portion 27 is divided by cross-like dividing grooves 28 and has at its tip end an expanded head 29, cross-like convex rows 30 are formed in alignment with the dividing grooves 28 on a bottom face of the knob portion 25, a through hole 20 is provided inside the shaft-bearing portion 11 such that a small-diameter hole 21 is formed on an upper side and a large-diameter hole 22 is formed on a lower side thereof, and cross-like concave grooves 23 are provided in a top face of the shaft-bearing portion 11 so as to coincide with the convex rows 30, wherein the shaft portion 27 of the knob body 5 is adapted to be inserted rotatably into the shaft-bearing portion 11. Consequently, the knob portion 25 that is easy to grip can be formed, the knob portion 25 can be attached to the main body 4 easily. Further, the knob portion 25 can be rotated intermittently by twisting so that the twisting operation can be carried out accurately.

Still further, according to the fifth aspect of the present invention, there is provided a twist latch wherein a socket 2 corresponding to the plug 1 has a cylindrical portion 42 formed in a base 41 of a main body 40 thereof and having an inside diameter larger than an outside diameter of a contracted diameter portion 12 of the shaft-bearing portion 11 of the plug 1, several protruded ridge portions 43 are provided on an outer periphery of the cylindrical portion 42 on a side of its top end so as to form an engaging portion 44, and a fixing plate 6 is provided with tongue-like fitting portions 37 formed in an inner periphery thereof and adapted to be fit onto said engaging portion 44. Consequently, the socket 2 for the twist latch can be produced easily in a shape suitable for the plug 1 and can be mounted firmly to the cloth C.

Still further, according to the sixth aspect of the present invention, there is provided a twist latch wherein the engaging portion 15 of the shaft-bearing portion 11 of the main body 4 of the plug 1 and the engaging portion 44 of the cylindrical portion 42 of the main body 40 of the socket 2 are identical in shape, and each of the engaging portions 15, 44 is formed with inclined faces 17, 45 on a side for inserting the fixing plate 6 and horizontal faces 18, 46 on a bottom thereof at a predetermined interval, respectively. Consequently, the engaging portions 15, 44 that are common to the plug main body 4 and the socket main body 40 can be formed easily and the fixing plate 6 that is also common to the plug main body 4 and the socket main body 40 can be set easily so that the twist latch can be attached easily corresponding to the cloth C.

Still further, according to the seventh aspect of the present invention, there is provided a twist latch wherein the fixing plate 6 for the plug 1 and the fixing plate 6 for the socket 2 are identical in shape so that it can be commonly used for the plug 1 and the socket 2. Consequently, the fixing plate 6 can be used for both the plug 1 and socket 2 in common, so that an effective attachment work can be achieved.

Still further, according to the eighth aspect of the present invention, there is provided a twist latch wherein the shaft-bearing portion 11 of the main body 4 of the plug 1 and the cylindrical portion 42 of the main body 40 of the socket 2 has an ellipse cross sectional outer shape, and the engaging portion 15, 44 is respectively provided on an entire periphery thereof. Consequently, the main body 4 of the plug 1 and the main body 40 of the socket 2 can be fixed firmly to the cloth C in a stabilized condition.

Still further, according to the ninth aspect of the present invention, there is provided a twist latch wherein the periphery of the hole portion 32 of the fixing plate 6 is formed with several cutout portions 36 provided in the periphery of the hole portion 32 so as to form the tongue-like fitting portions 37. Consequently, the fixing plate 6 can be fit to the main body 4 of the plug 1 or the main body 40 of the socket 2 easily and smoothly, and it can be further fixed firmly.

Finally, according to the tenth aspect of the present invention, there is provided a twist latch wherein the main body 4, the knob body 5 and the fixing plate 6 of the plug 1 and the main body 40 of the socket 2 are molded by injection molding or extrusion using thermoplastic resin. Consequently, the twist latch can be produced very easily and these products can be recycled. Therefore, the effects, which the present invention achieves, are very remarkable.

What is claimed is:

1. A twist latch including a plug comprising: a main body having a cylindrical shaft-bearing portion protruded from a base; a knob body having a shaft portion containing a knob portion at an end portion thereof and adapted to be supported rotatably by said shaft-bearing portion; and a fixing plate adapted to be mounted onto and fit to an outer face of said shaft-bearing portion, wherein said shaft-bearing portion has an engaging portion in an intermediate portion thereof, said fixing plate has a hole portion in which said shaft-bearing portion can be inserted, and said hole portion has fitting portions formed on a periphery thereof and adapted to be fit onto said engaging portion.

2. A twist latch according to claim 1, wherein an outer peripheral face of the shaft-bearing portion of the main body of the plug is formed with a contracted diameter portion, whose diameter is smaller, extending from a top end to an intermediate portion of the shaft portion while an outer peripheral portion thereof extending from the intermediate portion to the base is formed with an expanded diameter portion, the engaging portion being formed at said expanded diameter portion on a side of a beginning end thereof.

3. A twist latch according to claim 1, wherein the engaging portion provided on the shaft-bearing portion of the main body of the plug is formed of several protruded ridge portions protruded from an outer peripheral face of the shaft-bearing portion and the fixing plate has tongue-like fitting portions capable of being fit between the protruded ridge portions.

4. A twist latch according to claim 3, wherein the periphery of the hole portion of the fixing plate is formed with several cutout portions provided in the periphery of the hole portion so as to form the tongue-like fitting portions.

5. A twist latch according to claim 1, wherein the knob body of the plug has a shaft portion protruding from a bottom face of the knob portion, the shaft portion is divided by cross-like dividing grooves and has at a tip end thereof an expanded head, cross-like convex rows are formed in alignment with the dividing grooves on a bottom face of the knob portion, a through hole is provided inside the shaft-bearing portion such that a small-diameter hole is formed on an upper side and a large-diameter hole is formed on a lower side thereof, and cross-like concave grooves are provided in a top face of the shaft-bearing portion so as to coincide with the convex rows, the shaft portion of the knob body being adapted to be inserted rotatably into the shaft-bearing portion.

6. A twist latch according to claim 1, wherein a socket corresponding to the plug has a cylindrical portion formed in a base of a main body thereof and having an inside diameter larger than an outside diameter of a contracted diameter portion of the shaft-bearing portion of the plug, several protruded ridge portions are provided on an outer periphery of the cylindrical portion on a side of its top end so as to form an engaging portion, and a fixing plate is provided with tongue-like fitting portions formed in an inner periphery thereof and adapted to be fit onto said engaging portion.

7. A twist latch according to claim 1 or 6, wherein the engaging portion of the shaft-bearing portion of the main body of the plug and the engaging portion of the cylindrical portion of the main body of the socket are identical in shape, and each of the engaging portions is formed with inclined faces on a side for inserting the fixing plate and horizontal faces on a bottom thereof at a predetermined interval, respectively.

8. A twist latch according to claim 1 or 6, wherein the fixing plate for the plug and the fixing plate for the socket are identical in shape so that it can be commonly used for the plug and the socket.

9. A twist latch according to claim 1 or 6, wherein the shaft-bearing portion of the main body of the plug and the cylindrical portion of the main body of the socket has an ellipse cross sectional outer shape, and the engaging portion is respectively provided on an entire periphery thereof.

10. A twist latch according to claim 1 to 6, wherein the main body, the knob body and the fixing plate of the plug and the main body of the socket are molded by injection molding or extrusion using thermoplastic resin.

* * * * *